US010578292B1

(12) United States Patent
Yamasaki

(10) Patent No.: US 10,578,292 B1
(45) Date of Patent: Mar. 3, 2020

(54) TACTICAL ADVANTAGE FLASHLIGHT

(71) Applicant: Mag Instrument, Inc., Ontario, CA (US)

(72) Inventor: John Yamasaki, Ontario, CA (US)

(73) Assignee: MAG INSTRUMENT, INC., Ontario, CA (US)

( * ) Notice: Subject to any disclaimer, the term of this patent is extended or adjusted under 35 U.S.C. 154(b) by 0 days.

(21) Appl. No.: 16/391,734

(22) Filed: Apr. 23, 2019

Related U.S. Application Data

(62) Division of application No. 15/865,500, filed on Jan. 9, 2018.

(51) Int. Cl.
*F21V 23/04* (2006.01)

(52) U.S. Cl.
CPC ..... *F21V 23/0414* (2013.01); *F21V 23/0407* (2013.01)

(58) Field of Classification Search
CPC ..... F21V 23/0414; F21V 23/0407
See application file for complete search history.

(56) References Cited

U.S. PATENT DOCUMENTS

| | | | | |
|---|---|---|---|---|
| 9,549,454 | B2 ‡ | 1/2017 | Maglica | F21L 4/005 |
| 9,759,414 | B2 ‡ | 9/2017 | West | H05B 33/0854 |
| 2007/0258236 | A1 ‡ | 11/2007 | Miller | F21L 4/00 362/205 |
| 2008/0074868 | A1 ‡ | 3/2008 | Steele | F21L 4/025 362/184 |
| 2009/0009987 | A1 ‡ | 1/2009 | Graham | F21V 21/0885 362/110 |
| 2017/0299163 | A1 ‡ | 10/2017 | Wille | F21V 21/406 |

‡ imported from a related application

*Primary Examiner* — Kevin Quarterman
(74) *Attorney, Agent, or Firm* — Roy L. Anderson

(57) ABSTRACT

A tactical flashlight provides an improved tactical advantage useful in life-threatening situations by being configured so that it will operate in a disorientingly bright mode while pressure is applied to its finger activated electronic switch but then automatically switch to a strobe mode when pressure is released from the electronic switch.

4 Claims, No Drawings

TACTICAL ADVANTAGE FLASHLIGHT

CROSS-REFERENCE TO RELATED APPLICATIONS

This application is a divisional application of U.S. Ser. No. 15/865,500, filed Jan. 9, 2018, the disclosure of which is specifically incorporated herein by reference in its entirety.

FIELD OF THE INVENTION

The field of the present invention is flashlights and, more particularly, flashlights that are used by law enforcement personnel for tactical purposes.

BACKGROUND OF THE INVENTION

Tactical flashlights for police and military use are well known. It is also well known that such flashlights can operate in different modes such as a full power mode, a reduced power mode, a blink or strobe mode, an SOS mode and a momentary mode of operation. It is also well known that the sequencing of such modes of operation can be programmed by a user, and examples of such tactical flashlights are disclosed in U.S. Pat. Nos. 9,549,454 and 9,759,414, the disclosures of which are specifically incorporated herein by reference in their entireties.

SUMMARY OF THE INVENTION

The present invention is generally directed to a tactical flashlight, and a method of using it, which gives a specific advantage to its user in potentially life and death situations in which the flashlight is configured so that it will operate in a disorientingly bright mode while pressure is applied to its finger activated electronic switch but then automatically switch to a strobe mode when pressure is released from the electronic switch. The strobe mode is turned off when the switch is actuated again while additional modes of operation can be chosen by initially actuating the switch in a preselected manner.

Accordingly, it is a primary object of the present invention to provide a tactical flashlight which provides an improved tactical advantage useful in life-threatening situations.

This and further objects and advantages will be apparent to those skilled in the art in connection with the detailed description set forth below.

DETAILED DESCRIPTION OF THE INVENTION

Tactical flashlights are important tools for use by law enforcement personnel.

For example, a law enforcement officer might need to make a stop of a moving vehicle at night in a dimly lit or dark area. In this scenario, the officer might be facing a potentially life-threatening situation, depending upon who is in the moving vehicle being stopped. It is especially desirable, in such a situation, that the officer approaching the stopped vehicle from the rear use a flashlight in a disorientingly bright mode which helps disorient persons in the vehicle being approached while also making it harder for any such person to accurately aim a gun at the approaching officer. As the officer gets closer to the vehicle, and can see that there is no immediate visible danger to the officer, it is desirable to reduce the output of the flashlight, so that it is not so blinding to occupants of the vehicle. It may also be desirable to further reduce the output of the flashlight if the officer only needs the flashlight to read something, or use it for writing up a ticket.

Another situation in which a law enforcement officer might need to use a flashlight in a potentially life-threatening situation is when an officer enters a structure which is not well lighted or dark. In this scenario, the officer may wish to use a very bright mode of operation to see as much as possible within the structure.

In both scenarios just mentioned, the officer's life may be at risk if a bad actor gets a gunshot off at the officer. In this potentially life-threatening situation, the officer may drop the flashlight, or even be injured while still holding the flashlight, before having time to turn the flashlight off, which can reveal the officer's location for purposes of receiving additional fire, potentially making a very serious situation even worse. It is precisely for such situations (and situations that might arise in other environments, e.g., military environments) that the present invention offers a new tactical advantage to the person using it.

In accordance with the present invention, a tactical flashlight is operated in a disorientingly bright mode for only so long as the person using the flashlight applies pressure to the flashlight's switch and then, once the pressure ceases to be applied, the tactical flashlight automatically goes into a strobe mode of operation. The strobe mode of operation is critical to situations addressed by the present invention because a strobe mode of operation will draw a viewer's eye to the strobe, providing an important extra diversion that might make the difference between life and death of the officer in a life-threatening situation. Also, because the strobe mode is automatically activated, like a dead man's switch which is often used as a fail-safe mechanism to stop a machine, it does not require additional time for the user to activate the change, as is the current industry practice for tactical flashlights. While the time saved might appear to be small, it might be the difference between life and death in some life-threatening situations.

Because not all situations in which a tactical flashlight is used will be life-threatening situations, there is still a need for a tactical flashlight to conveniently operate in other modes of operation, such as reduced power or an even further economical mode of operation with still even less power, which also helps conserve battery life and, depending upon the intensity of light output from the flashlight, is easier for use in reading or providing light for writing. Such modes of operation can be actuated by rapidly clicking an electronic switch as taught in U.S. Pat. No. 9,759,414, which also describes how the sequencing of such modes of operation can be programmed, although the details of such operations are not important to the present invention and thus are simply referenced for ease of understanding of the present invention.

Accordingly, in accordance with the present invention, the default mode of operation, either a disorientingly bright mode or a strobe mode, is easily activated, when the flashlight is turned on; all a user has to do is press the electronic on switch on with no other action required other than holding the switch on to operate in the disorientingly bright mode or release the switch to operate in the strobe mode. Once the strobe mode is actuated, the flashlight can be turned off by again pressing the electronic switch. Finally, the flashlight can be operated in other modes of operation by taking prescribed steps when the flashlight is turned on by actuating the electronic switch. For example, other modes of operations, such as reduced light output modes, can be actuated by several rapid clicks of the electronic switch. The key point is that while the electronics of the flashlight can be configured (e.g., by appropriate programming of a microcontroller) to allow a user to use the flashlight in other modes of operation, by various prescribed actions involving the electronic switch, no action, other than turning the flashlight on, is required to initiate the core modes of disorientingly bright which essentially instantly converts to strobe when pressure is no longer being applied to the electronic switch.

While the invention has been described herein with reference to certain preferred embodiments, those embodiments have been presented by way of example only, and not to limit the scope of the invention. Additional embodiments thereof will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions.

What is claimed is:

1. A method of operating a tactical flashlight, comprising the steps of causing the tactical flashlight to operate in either a default mode of operation or an expanded mode of operation, wherein in the default mode of operation the tactical flashlight operates in a first mode of operation as long as pressure is applied to a finger actuation mechanism but in a second mode of operation once pressure is no longer applied to the finger actuation mechanism whereas in the expanded mode of operation the tactical flashlight operates in a third mode of operation, wherein a profile of light emitted from the tactical flashlight in each of the first, second and third modes of operation is different than the profile of light emitted in the other two of said first, second and third modes of operation, and wherein the tactical flashlight will not operate in the expanded mode of operation unless a user of the tactical flashlight takes a prescribed action involving the finger actuation mechanism.

2. The method of claim 1, wherein the first mode of operation is a disorientingly bright mode, the second mode of operation is a strobe mode and the third mode of operation is a reduced power mode in which the amount of light output by a light source of the tactical flashlight is less than that which is output by the light source in the disorientingly bright mode.

3. The method of claim 1, wherein the prescribed action is releasing an initial pressure applied to the finger actuation mechanism and then reapplying pressure to the finger actuation mechanism within a preselected amount of time.

4. The method of claim 1, wherein the prescribed action is applying pressure to the finger actuation mechanism in a prescribed pattern after the tactical flashlight has operated in the strobe mode for greater than a preselected amount of time.

* * * * *